US006877759B2

(12) United States Patent
Dandurand

(10) Patent No.: US 6,877,759 B2
(45) Date of Patent: Apr. 12, 2005

(54) SKI BINDING

(76) Inventor: Louis Dandurand, 1904 Hazens Notch Rd., Montgomery Center, VT (US) 05471-3090

( * ) Notice: Subject to any disclaimer, the term of this patent is extended or adjusted under 35 U.S.C. 154(b) by 208 days.

(21) Appl. No.: 10/229,152

(22) Filed: Aug. 27, 2002

(65) Prior Publication Data

US 2004/0041366 A1 Mar. 4, 2004

(51) Int. Cl.[7] ..... A63C 9/00
(52) U.S. Cl. ..... 280/614; 280/605; 280/623
(58) Field of Search ..... 280/604, 605, 280/607, 611, 613, 614, 615, 621, 623, 624, 634, 628, 14.21; D21/766, 773, 771

(56) References Cited

U.S. PATENT DOCUMENTS

| | | | | | |
|---|---|---|---|---|---|
| 3,647,233 | A | * | 3/1972 | Martin | 280/632 |
| 3,907,319 | A | * | 9/1975 | Berlied, Jr. | 280/615 |
| 3,989,273 | A | * | 11/1976 | Schmidt | 280/631 |
| 4,230,338 | A | * | 10/1980 | Weigl et al. | 280/618 |
| 4,533,154 | A | * | 8/1985 | Bernard et al. | 280/615 |
| 4,659,103 | A | * | 4/1987 | Tessaro | 280/615 |
| 4,836,572 | A | * | 6/1989 | Pozzobon | 280/613 |
| 4,913,455 | A | * | 4/1990 | Salsetti et al. | 280/615 |
| 4,917,399 | A | | 4/1990 | Holzl | |
| 5,338,053 | A | * | 8/1994 | Hauglin | 280/615 |
| 5,551,721 | A | * | 9/1996 | Renaud-Goud et al. | 280/605 |
| D375,773 | S | | 11/1996 | Haughlin | |
| 5,823,563 | A | | 10/1998 | Dubuque | |
| 5,957,478 | A | | 9/1999 | Vigny | |
| 5,997,026 | A | * | 12/1999 | Klubitschko et al. | 280/607 |
| D425,162 | S | | 5/2000 | Hauglin | |
| 6,092,830 | A | | 7/2000 | Wheeler | |
| 6,105,994 | A | | 8/2000 | Parris | |
| 6,299,193 | B1 | | 10/2001 | Parris et al. | |
| 6,308,979 | B1 | | 10/2001 | Ludlow | |
| 6,322,095 | B1 | | 11/2001 | Wheeler | |
| 6,409,204 | B1 | | 6/2002 | Ayliffe | |
| 6,623,027 | B1 | * | 9/2003 | Wheeler | 280/623 |

FOREIGN PATENT DOCUMENTS

| | | |
|---|---|---|
| AT | 375835 B | 9/1984 |
| AT | 386127 B | 7/1988 |
| DE | 2906520 A | 8/1980 |
| EP | 0176951 A | 4/1986 |

* cited by examiner

*Primary Examiner*—Christopher P. Ellis
*Assistant Examiner*—Christopher Bottorff
(74) *Attorney, Agent, or Firm*—David M. Driscoll

(57) ABSTRACT

A step-in binding for receiving a ski boot and preferably for telemark skiing. The binding includes a base constructed and arranged to be secured to the ski and a pair of boot support members pivotally supported from a front side of the base, and disposed laterally on either side of the base. The lateral side members may be tapered inwardly toward the front so as to receive and guide the ski boot as it is to be engaged. The pair of boot support members are biased to a boot receiving position and further having a locked position that is assumed once the boot is received, engages the pair of boot support members, and is cantilevered downwardly into the locked position.

45 Claims, 6 Drawing Sheets

SKI BINDING

BACKGROUND OF THE INVENTION

The present invention relates in general to ski bindings, and pertains, more particularly, to ski bindings that are preferably used with a Telemark ski.

One traditional Telemark ski binding employs a front latch for securing the boot in the binding. This is typically referred to as a three pin 75 mm Nordic Norm binding. These types of bindings have traditionally required the skier to bend down and manually press down upon a latch mechanism at the front of the toe of the ski boot to attach the ski boot to the binding. This is a rather cumbersome arrangement, and it is time consuming in engaging the ski boot with the binding.

Another traditional Telemark binding employs a heel cable to secure the boot to the binding. This also is a cumbersome arrangement requiring time consuming positioning and adjustment for proper securing of the ski boot to the binding. Also, the cable may affect the overall flexibility and use of the ski by the skier.

It is an object of the present invention to provide an improved ski binding, preferably for use with a Telemark ski and in which the binding is a step-in binding.

Another object of the present invention is to provide a ski binding that is of the step-in type and that comprises a toe piece that the boot can readily engage and means for simple and ready disengagement.

Still another object of the present invention is to provide a ski binding with an integral ski brake, particularly a step-in type binding for telemark skiing.

SUMMARY OF THE INVENTION

In accordance with the present invention there is provided a step-in binding for receiving a ski boot, comprising: a base constructed and arranged to be secured to the ski; and a pair of boot support members pivotally supported from a front side of the base, and disposed laterally on either side of the base. The pair of boot support members is biased to a boot receiving or open position and further has a locked or closed position that is assumed once the boot is received, engages the pair of boot support members, and is cantilevered downwardly into the locked position. A release lever is arranged at the front of the base, readily accessible to the skier and includes a member that releases the pair of boot support members from the locked position to the boot receiving or boot released position upon activation of the release lever.

In accordance with other features of the present invention there are the following aspects. A base has a pressure plate on a front top surface that firmly engages an underside of the boot. The pressure plate is slightly elevated above the rest of the top surface of the base and includes securing pins engageable in holes in the boot for retaining the boot in place. A cross bar is disposed between the pair of boot support members for engaging the front top of the boot and a pair of stop posts are associated respectively with the pair of support members. The member that releases the pair of support members includes a latch pin that extends through the base retained at its front end at the release lever and has a back end that engages and locks the pair of support members. A cross piece preferably extends between the lateral support members for engagement with the back end of the latch pin, the latch pin being tapered at its back end so as to displace when the lateral support members move downwardly yet lock with the cross piece when filly engaged. A spring is for biasing the latch pin toward a backward position, the base having a front to back passage for receiving the latch pin. The base comprises an outer metal shell and an inner plastic core that has the passage therein. The release lever may be supported from the base by means of a pivot pin, the release lever held by the pivot pin and supported at the front end of the latch pin. Preferably a ski brake is integrated into the base and has wings that extend through the pair of lateral support members. At least one spring is disposed in the base for biasing the brake and for urging the later support members away from the locked position.

In accordance with another aspect of the present invention there is provided a step-in binding for receiving a ski boot for telemark skiing, comprising: a base constructed and arranged to be secured to the ski; and a pair of boot support members pivotally supported from a front side of the base, and disposed laterally on either side of the base. The lateral side members are preferably tapered inwardly toward the front so as to receive and guide the ski boot as it is to be engaged. The pair of boot support members is biased to a boot receiving position and further has a locked position that is assumed once the boot is received, engages the pair of boot support members, and is cantilevered downwardly into the locked position. A release lever is arranged at the front of the base, readily accessible to the skier and including a member that releases the pair of boot support members from the locked position to the boot receiving position upon activation of the release lever. A ski brake is integrated into the base, releasable should the boot become disengaged, and constructed and arranged to urge the lateral support members from the locked position to the released position.

In accordance with other features of the present invention there are the following aspects. The base has a pressure plate on a front top surface that firmly engages an underside of the boot, and the pressure plate is slightly elevated above the rest of the top surface of the base and includes securing pins engageable in holes in the boot for retaining the boot in place. The member that releases the pair of support members includes a latch pin that extends through the base retained at its front end at the release lever and having a back end that engages and locks the pair of support members. A cross piece preferably extending between the lateral support members for engagement with the back end of the latch pin, the latch pin being tapered at its back end so as to displace when the lateral support members move downwardly, yet lock with the cross piece when fully engaged, a spring for biasing the latch pin toward a backward position, the base having a front to back passage for receiving the latch pin, and wherein the base comprises an outer metal shell and an inner plastic core that has the passage therein. A cross bar may be disposed between the pair of boot support members for engaging the front top of the boot and a pair of stop posts associated respectively with the pair of support members.

In accordance with still another aspect of the present invention there is provided a step-in binding for receiving a ski boot comprising: a base constructed and arranged to be secured to the ski, and a pair of boot support members mounted from a front side of the base, and disposed laterally on either side of the base. The lateral side members are adapted to receive and guide the ski boot as it is received. The pair of boot support members are biased to a boot released position and further have a locked position that is assumed once the boot is received, engages the pair of boot support members, and is cantilevered downwardly into the locked position. A release lever is mounted at the front of the base, readily accessible to the skier and includes a release member that releases the pair of boot support members from the locked position to the boot released position upon activation of the release lever.

In accordance with other features of the present invention there are the following aspects. A ski brake is integrated into the base, and constructed and arranged to urge the lateral support members from the locked position to the released position. The lateral side members are preferably tapered inwardly toward the front so as to receive and guide the ski boot as it is to be engaged. The member that releases the pair of support members includes a latch pin that extends through the base retained at its front end at the release lever and having a back end that engages and locks the pair of support members.

In accordance with still another aspect of the present invention there is provided a step-in binding for receiving a ski boot comprising a base constructed and arranged to be secured to the ski; and a boot support member supported from a front side of said base; The boot support member is biased to a boot receiving position and further has a locked position that is assumed once the boot is received, engages the boot support member, and is cantilevered downwardly into the locked position. A release lever is arranged at the front of the base, readily accessible to the skier and includes a member that releases the boot support member from the locked position to the boot receiving position upon activation of the release lever. A ski brake is integrated into the base, and constructed and arranged to urge the support member from the locked position to the released position.

DETAILED DESCRIPTION

Figure 7:
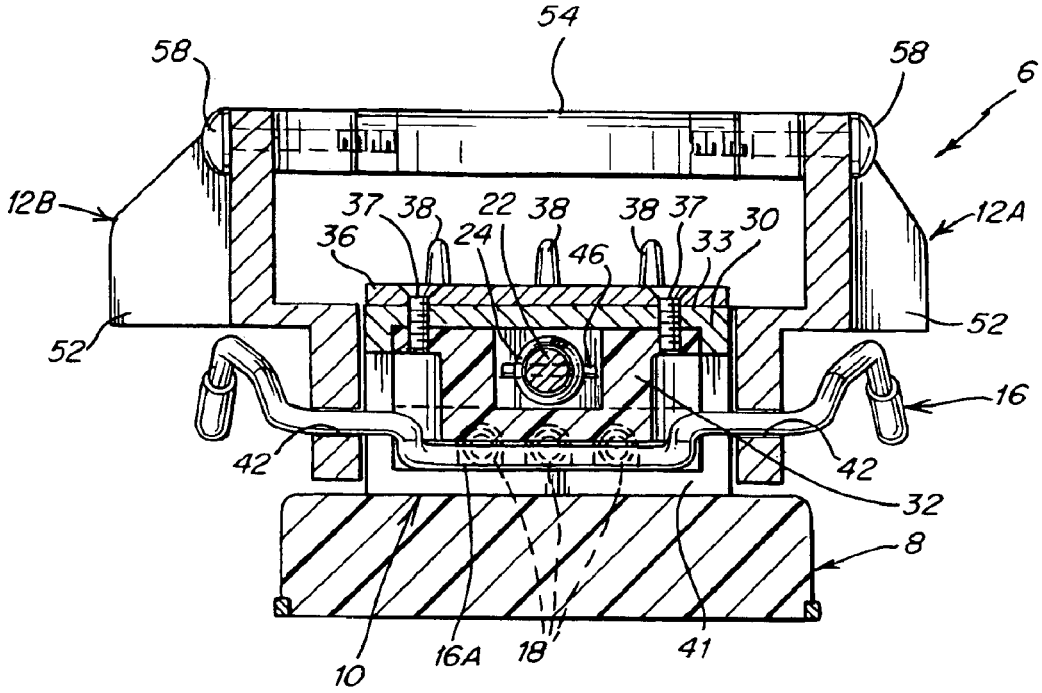
FIG. 7 is a cross-sectional end view of the binding taken along line 7—7 of FIG. 4.
Figure 8:
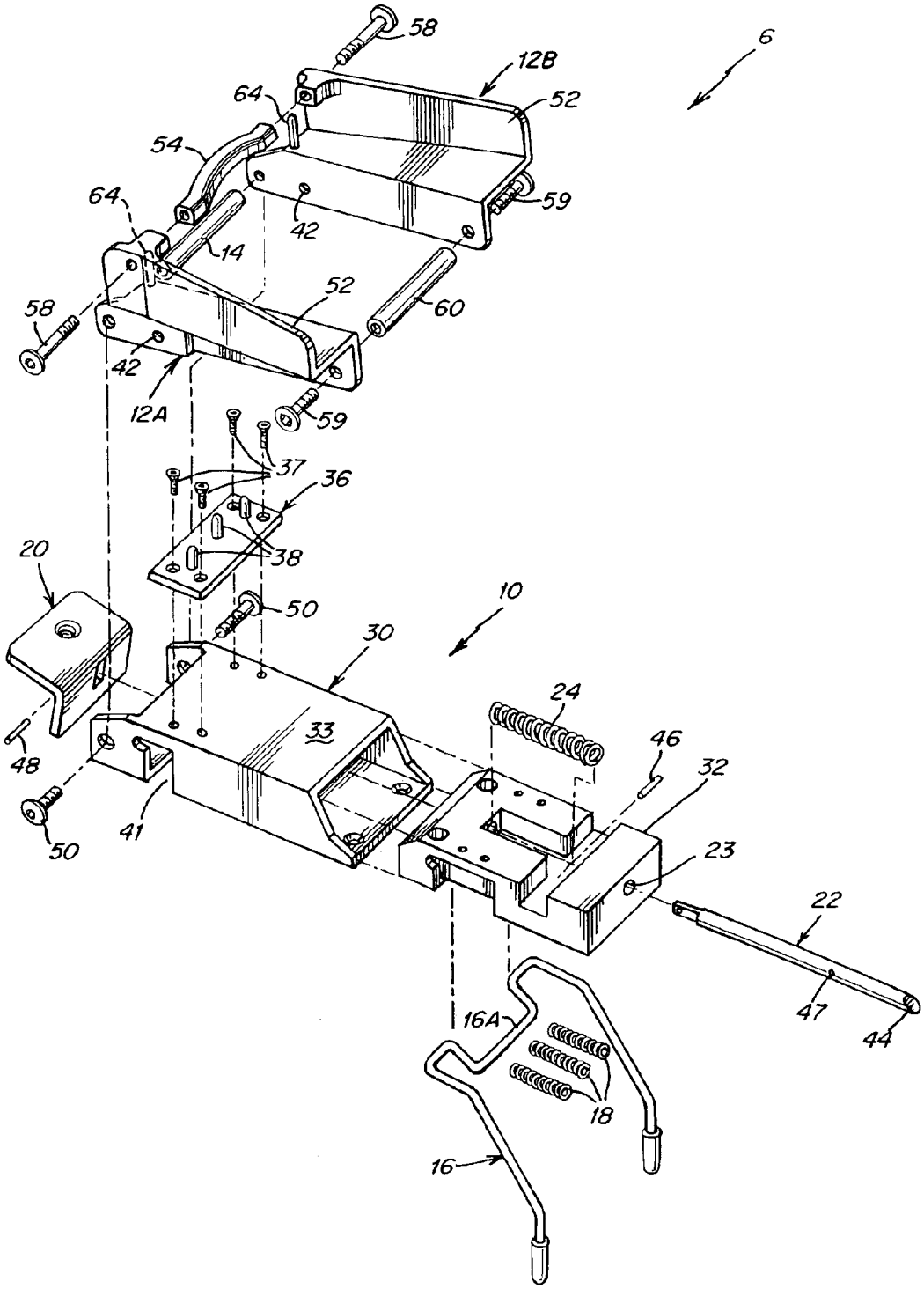
FIG. 8 is an exploded perspective view illustrating the components of the ski binding of the present invention.
Figure 9:
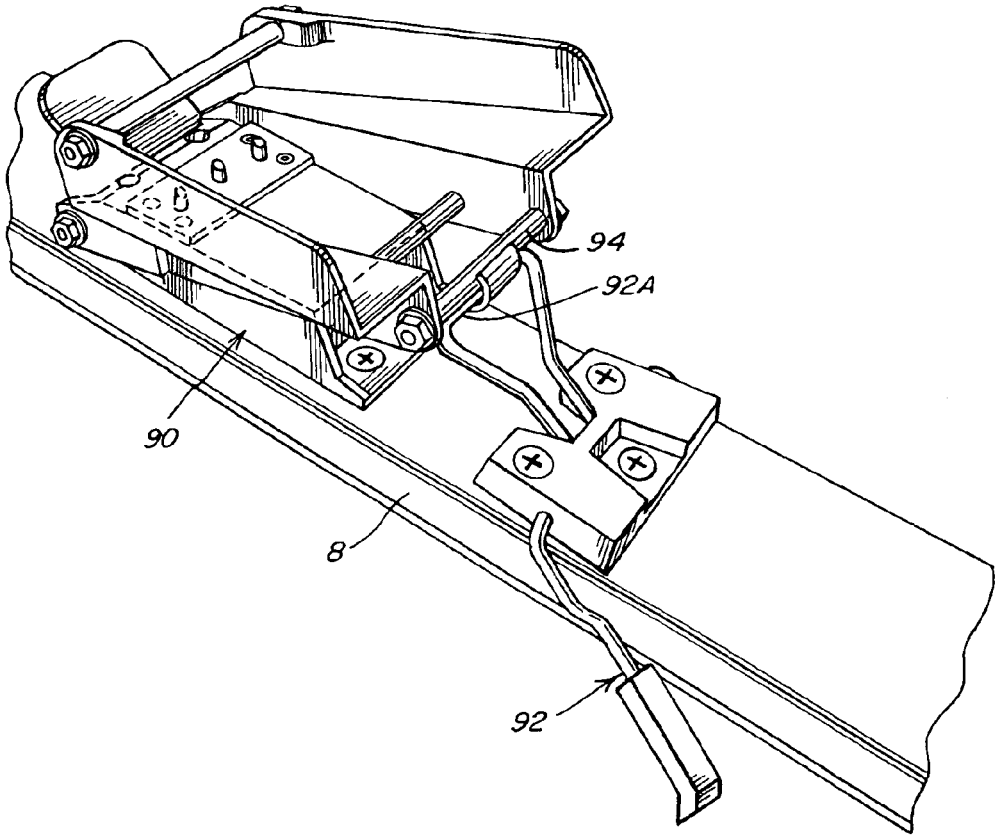
FIG. 9 is a perspective view similar to that illustrated in FIG. 1 but showing an alternate embodiment utilizing a rear mounted ski brake.

The step-in binding of the present invention is primarily anticipated as for use for Telemark skiing. A preferred embodiment of the binding is illustrated in FIGS. 1–8. An alternate ski brake construction is illustrated in FIG. 9. The binding 6 has a cantilever hinge or pivot arrangement that securely fastens the toe of the ski boot to the ski 8. The binding of the present invention is constructed in a very simple manner with an effective mechanism for securing a Telemark boot to the ski, in a step-in manner. With the arrangement of the present invention a skier, in a standing position, inserts the toe of the ski boot under a cross-bar and steps down on the binding mechanism thus attaching the boot to the binding in a step-in fashion. The boot is released from the binding by pressing a release lever or toggle in the front of the binding using, for example, a ski pole. The binding has a simple and yet sturdy and effective design. A ski brake is integrated into the binding thus alleviating the need for ski runaway straps.

Now, with reference to the preferred embodiment of the invention illustrated in FIGS. 1–8, the ski binding 6 is comprised of a center base or block 10 and a pair of boot support members 12A and 12B. The pair of boot support members is disposed laterally on either side of the base 10. These support members 12A and 12B are pivotally supported from the base at a front of the base by means of the pivot pin 14. A ski brake 16 is integrated into the base 10. The ski brake 16 not only functions as a brake for a runaway ski, but also springs 18 associated therewith provide a biasing force for assisting and urging the binding from its locked position to its released position. The release of the binding is facilitated by the use of the release lever 20. The release lever 20 operates the latch pin 22 which is biased by means of the latch pin spring 24.

Figure 1:
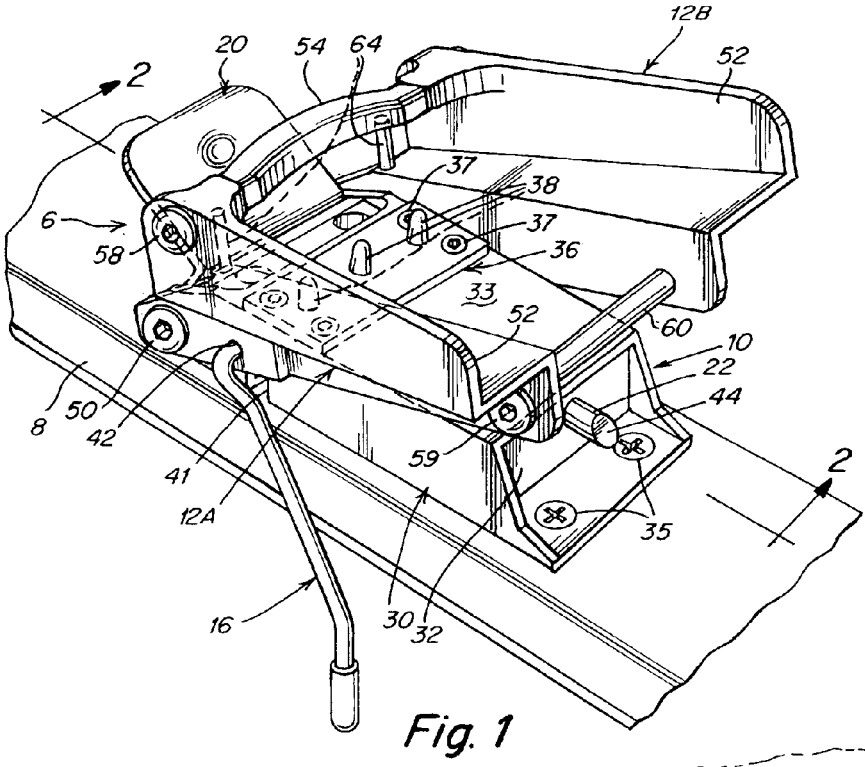
FIG. 1 is a perspective view of one embodiment of the binding of the present invention illustrated in the open position and with the ski brake extended.
Figure 2:
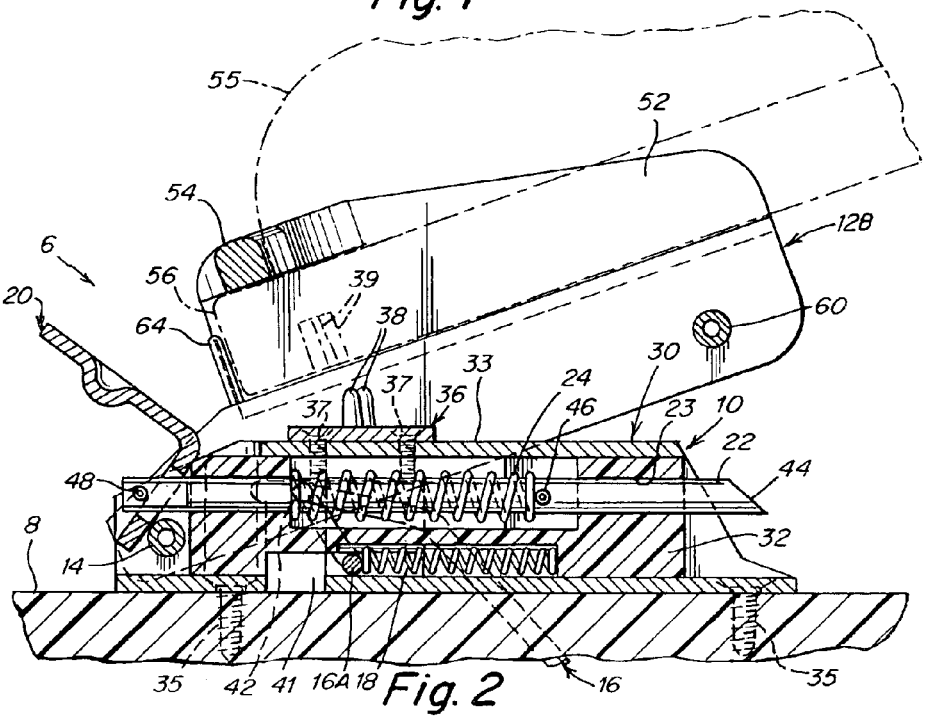
FIG. 2 is a cross-sectional side view taken along line 2—2 of FIG. 1.

The base 10 is comprised of a main channel member 30 having a passage for receiving the plastic block 32. The channel member 30 at its base wall has pairs of front and rear holes for receiving securing screws 35, such as illustrated in FIGS. 1 and 2 and for the purpose of securing the binding to the ski. The passage in the channel member 30 is dimensioned so as to snugly receive the plastic block 32. Means may be provided for holding the block 32 within the passage in the channel member 30. Such means may include screws 37 which also secure the pressure plate 36 to the channel member 30 as illustrated in FIG. 7. Other means may include an adhesive, or one can rely simply upon the close fit between the block and the channel member.

A pressure plate 36 is secured to the top surface at the front of the channel member 30. The pressure plate 36 supports three boot alignment pins 38. FIG. 2 illustrates these alignment pins 38 in the corresponding holes 39 in the sole of the ski boot. It is noted that the pressure plate 36 is elevated above the top surface 33 of the channel member 30. This assures that there is a good pressured fit of the boot to the pressure plate 36.

The base 10 supports the ski brake 16 as well as the binding release mechanism. The center loop 16A of the ski brake 16 is adapted for support within a lower slot in the plastic block 32. In the assembly of the mechanism, the ski brake 16 is engaged with the block through the channel member passage 41, as illustrated in FIG. 8. Opposite sides of the ski brake 16 also extend through respective holes 42 in the support members 12A and 12B. This inter-engagement between the ski brake 16 and the lateral support members 12A and 12B is instrumental in providing the releasing force for release of the binding from its locked position to its released position as illustrated in, for example, FIG. 1. Springs 18 disposed within the block 32 urge the ski brake 16 to the position illustrated in FIGS. 1 and 2, in other words its downward position. When the binding is moved to its locked position then the ski brake 16 rotates upwardly such as to the position illustrated in FIG. 4 with the brake urging against the springs 18. Note in FIG. 4 the more compressed state of the springs 18.

Also supported through the block 32 is the latch pin 22. Block 32 has a front to back passage 23 for receiving the latch pin 22. The rear end of the latch pin 22 is tapered as illustrated at 44. A pin 46 is used, passing though the latch pin 22 at passage 47 so as to secure in position one end of the spring 24. The very front end of the latch pin 22 is secured on the front side of the release lever 20 by means of a further pin 48 also passing through a hole at the front end of latch pin 22.

As indicated previously, the lateral support members 12A and 12B are pivotally supported from the base 10 by means of the pivot pin 14. The rear face of the release lever 20 is urged against pin 14. The pin 14 also functions as a spacer between the support members 12A and 12B, and assures that there is correct spacing between the support members and the pin 14. The pin 14 provides the main pivot for the lateral support members 12A and 12B and is attached to them by means of screws 50, as depicted in FIG. 8.

Figure 5:
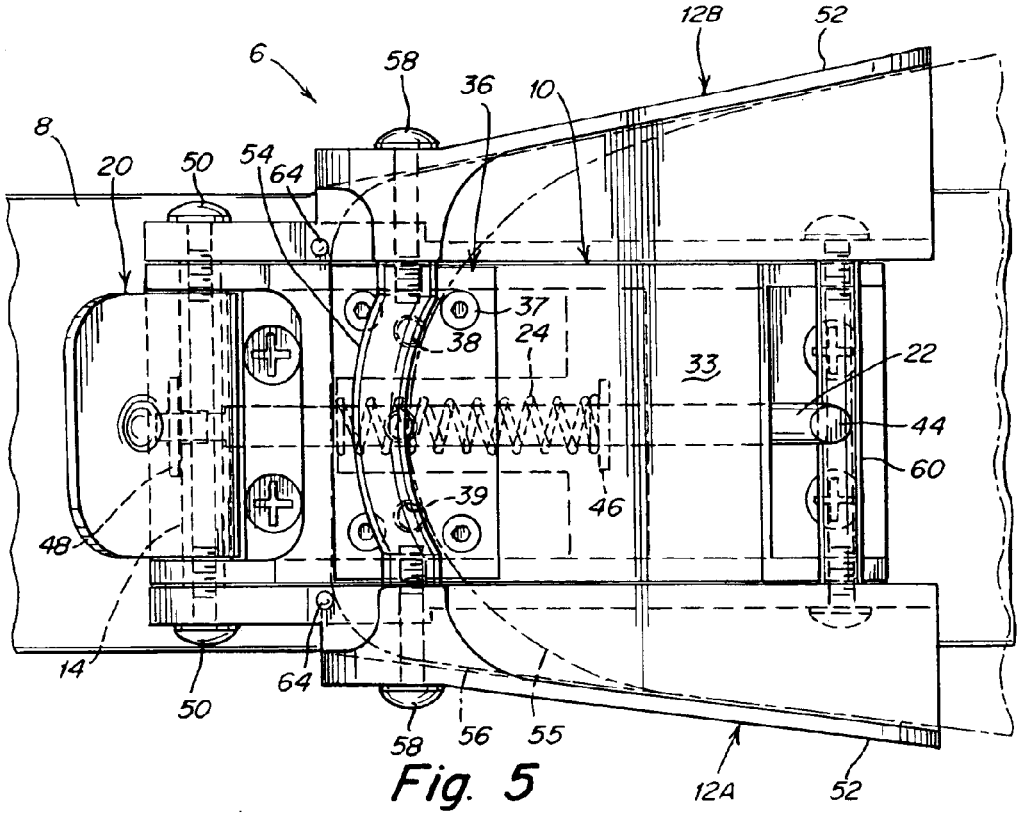
FIG. 5 is a top plan view of the binding as seen along line 5—5 of FIG. 4 with the binding in its latched position.
Figure 6:
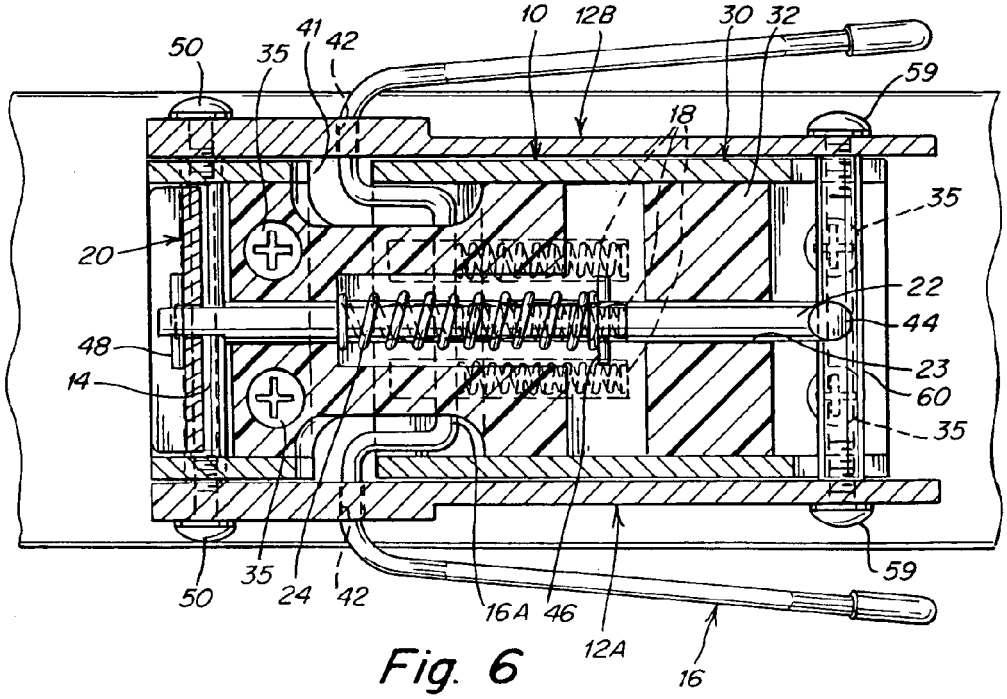
FIG. 6 is a cross-sectional plan view of the binding taken along line 6—6 of FIG. 4.

The lateral support members 12A and 12B each have tapered sidewalls 52 that are adapted to guide the boot as it is inserted, such as the boot 55 illustrated in FIG. 2. Also refer to FIG. 5 showing the convergence of the sidewalls 52. The boot is also engaged under the crossbar 54. The crossbar 54 preferably has a slight forward curvature so as to properly match the curved front of the ski boot. FIG. 2 illustrates the sole 56 of the ski boot being engaged under the crossbar 54. The crossbar 54 may be supported by screws 58, as illustrated in FIGS. 7 and 8. At the rear of the support members there is also provided another set of screws 59 that supports a spacer bar 60 extending between the support members. The spacers 14, 54 and 60 control the distance between the lateral support members, particularly as it relates to the side-to-side dimensions of the aluminum channel member 30. FIGS. 5 and 6 illustrate this corresponding spacing which is relatively close and yet provides free rotation therebetween. The lateral support members also support at their respective front sides, each a stop pin 64. The combination of these stop pins and the laterally directed walls 52 properly position the ski boot so that when the boot is moved to its locked position the boot is in proper alignment with the pins 38.

FIGS. 1 and 2 illustrate the ski binding of the present invention in its released position. In that position the lateral support members 12A and 12B are pivoted to their most upward position and the ski brake 16 is in its most downward position. As indicated previously, the springs 18 bias the spring brake to this downward position. In this position the release lever is also shown in its rest position. In FIG. 2 the boot has been inserted under the crossbar 54 and the skier is in readiness for engagement with the step-in binding.

Figure 3:
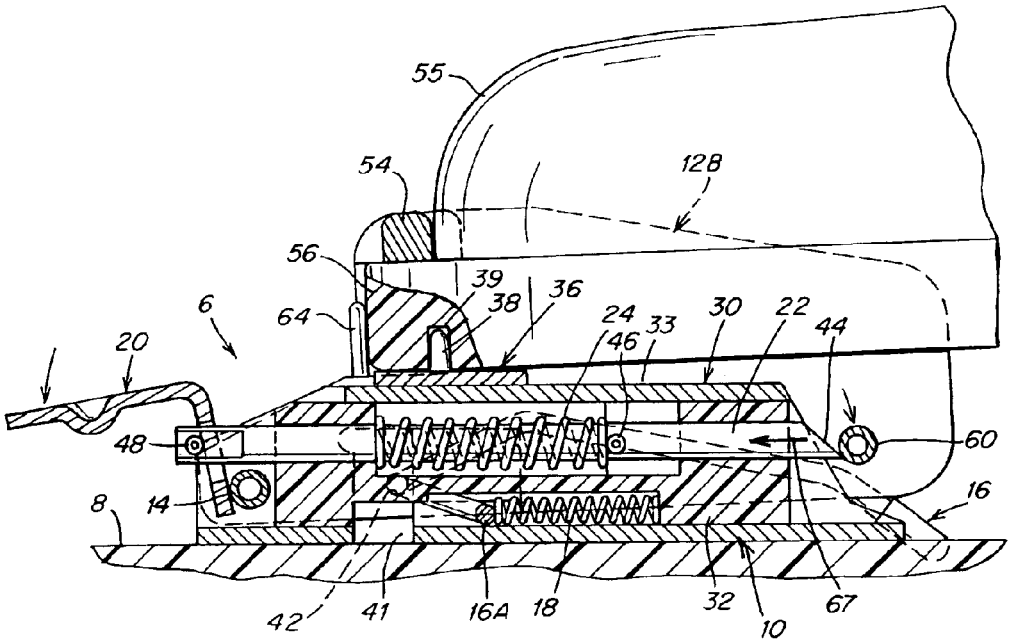
FIG. 3 is a cross-sectional side view similar to that illustrated in FIG. 2 but illustrating a boot engaged in the binding and with the binding being almost fully engaged or latched.

The cross-sectional view of FIG. 3 illustrates the ski boot being almost fully engaged by cantilevering the lateral support members toward their downward position by means of a downward pressure on the ski boot by the skier. In this view it is noted that the ski brake 16 has now moved to a more upward position against the bias of springs 18. The spacer bar 60 is now being urged against the tapered end 44 of the latch pin 22. However, in FIG. 3 the binding is not yet in its fully latched position as the spacer bar 60 is still riding upon the tapered surface 44. The ramping effect of the bar 60 against the tapered end 44 of the latch pin 22 causes the latch pin 22 to move in the direction of arrow 67. It is also noted in FIG. 3 that the release lever 20 has been moved toward a more downward position. Alternatively, when the boot is to be released from engagement with the binding, pushing down on the lever 20 with a ski pole or other means, causes a downward movement of the lever, which, in turn, causes the latch pin to move in the direction of arrow 67.

Figure 4:
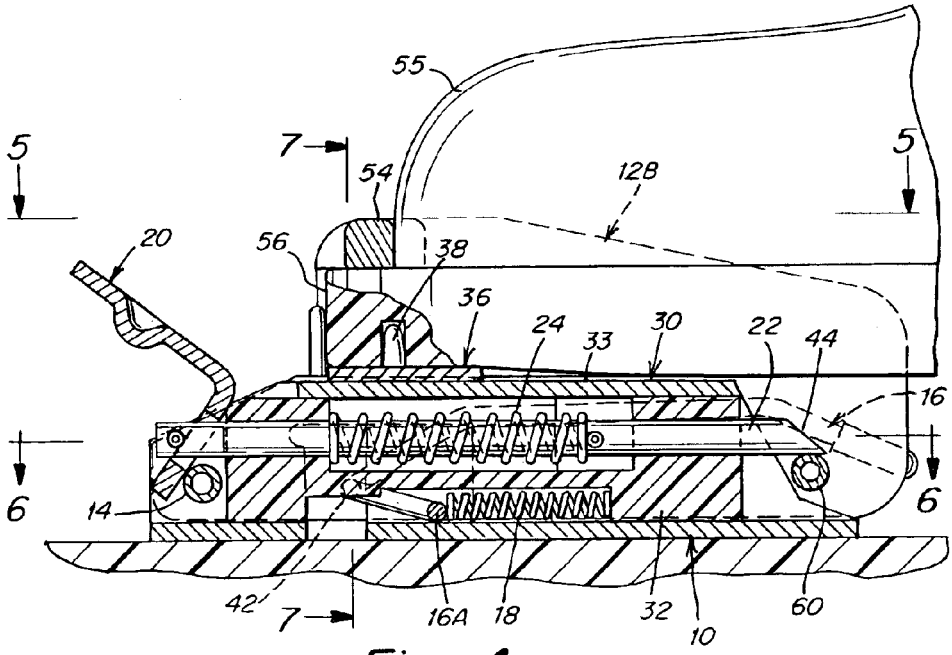
FIG. 4 is a cross-sectional view similar to that illustrated in FIGS. 2 and 3 but illustrating the binding now in a fully latched position.

FIG. 4 illustrates the binding now having been moved to its fully latched position. It is noted that in this position the spacer bar 60 has now moved under the latch pin 22. This action secures the binding in this closed or locked position. In this position it is also noted in FIG. 4 that the spring brake is in its full upward position and that the release lever has assumed its original position because the latch pin has now moved in the opposite direction indicated by arrow 69. The pin 22 is urged in this direction by means of the spring 24.

Reference is now made to FIG. 9 for an alternate embodiment of the invention. This embodiment of the invention also employs a step-in binding. The binding itself 90 is substantially identical to the binding 6 illustrated in FIGS. 1–8 with the exception that the binding illustrated in FIG. 9 does not include the ski brake integrated into the binding. Instead, there is a separate ski brake 92 illustrated in FIG. 9. To accommodate this separate ski brake 92, there is provided a connection of the ski brake at tubular member 94. This ski brake 92, like the ski brake 16 shown in FIGS. 1–8, biases the binding to a released position such as illustrated in FIG. 9. When the skier engages the binding and moves the lateral support members downwardly to a locked position, the ski brake center loop 92A may also move downwardly against the bias of a spring means associated with the ski brake 92 rotating the ski brake 92 upwards.

It can be readily seen from the foregoing description, that the step-in binding of this invention is a relatively simple construction and, in the preferred embodiment, incorporates the ski brake into the binding. The ski brake actually functions both as a brake and as a means for assisting in releasing the binding by means of the bias of associated ski brake springs.

Another feature of the present invention is the relative flatness of the entire mechanism, particularly at the top surface 33 and at the surfaces that the boot rest upon on the lateral support members. By making these surfaces flat, there is far less of a likelihood of snow and ice buildup between the ski boot and the binding surfaces.

Another feature of the present invention is the use of a separate pressure plate elevated slightly above the surface 33 that enables a firm pressure contact with the boot, between the pressure plate 36 and the crossbar 54.

Still another feature of the present invention is the preferred front positioning of the release lever. Many times release levers are disposed on the back of the binding and this makes it quite difficult to have access thereto. In accordance with the present invention the release lever is readily accessible at the front of the binding and preferably has an indentation therein to receive, for example, the end of a ski pole.

Another feature of the present invention relates to the simplified construction, such as the use of three crossbars that are used to unify the lateral support members. The front bar forms the hinge mechanism, the bar across the top of the boot holds the boot in place, and the rear bar locks the lateral member down. This locking down occurs between the spacer 60 and the pin 22. Also, it is noted that the cross bars (spacers) abut to the inner surface of the lateral members thus maintaining the width necessary to receive the center block. These pins that support the bars or spacers are held in place with a screw through the lateral members and threaded into them.

Having now described a limited number of embodiments of the present invention, it should be now apparent to those skilled in the art that numerous embodiments, modifications and equivalents are contemplated as following within the scope of the present invention as defined by the appended claims. For example, the lateral boot support members and crossbar over the toe of the boot may be constructed as a single molded part that covers the whole front of the boot sole.

What is claimed is:

1. A step-in binding for receiving a ski boot, comprising:

a base constructed and arranged to be secured to the ski;

a pair of boot support members pivotally supported from a front side of said base, and disposed laterally on either side of said base;

said pair of boot support members being biased to a boot receiving position and further having a locked position that is assumed once the boot is received, engages the pair of boot support members, and is cantilevered downwardly into the locked position;

a cross bar disposed transversely between the pair of boot support members for engaging the front top of the boot sole; and a release lever arranged at the front of said base readily accessible to the skier and a member that releases the pair of boot support members from the locked position to the boot receiving position upon activation of said release lever;

said cross bar disposed over the front top of the boot sole so that the center of said cross bar receives the most forward portion of the toe box of the boot with the ends of the cross bar extending rearwardly therefrom to engage outer portions of the boot sole.

2. A step-in binding for receiving a ski boot, comprising:

a base constructed and arranged to be secured to the ski;

a pair of boot support members pivotally supported from a front side said base, and disposed laterally on either side of said base;

said pair of boot support members being biased to a boot receiving position and further having a locked position that is assumed once the boot is received, engages the pair of boot support members, and is cantilevered downwardly into the locked position; and a release lever arranged at the front of said base readily accessible to the skier and a member that releases the pair of boot support members from the locked position to the boot receiving position upon activation of said release lever;

wherein said base has a pressure plate on a front top surface that firmly engages an underside of the boot.

3. A step-in binding as set forth in claim 2 wherein the pressure plate is slightly elevated above the rest of the top surface of the base and includes securing pins engageable in holes in the boot for retaining the boot in place.

4. A step-in binding as set forth in claim 1 including a pair of stop posts associated respectively with the pair of support members.

5. A step-in binding for receiving a ski boot, comprising:

a base constructed and arranged to be secured to the ski;

a pair of boot support members pivotally supported from a front side of said base, and disposed laterally on either side of said base;

said pair of boot support members being biased to a boot receiving position and further having a locked position that is assumed once the boot is received, engages the pair of boot support members, and is cantilevered downwardly into the locked position; and a release lever arranged at the front of said base readily accessible to the skier and a member that releases the pair of boot support members from the locked position to the boot receiving position upon activation of said release lever;

wherein the member that releases the pair of support members includes a latch pin that extends through the base retained at its front end at the release lever and having a back end that engages and locks the pair of support members.

6. A step-in binding as set forth in claim 5 including a cross piece extending between the lateral support members for engagement with the back end of the latch pin, said latch pin being tapered at its back end so as to displace when the lateral support members move downwardly yet lock with the cross piece when fully engaged.

7. A step-in binding as set forth in claim 6 including a spring for biasing the latch pin toward a backward position, said base having a front to back passage for receiving said latch pin.

8. A step-in binding as set forth in claim 7 wherein said base comprises an outer metal shell and an inner plastic core that has the passage therein.

9. A step-in binding as set forth in claim 5 wherein said release lever is supported from said base by means of a pivot pin, said release lever held by said pivot pin and supported at the front end of said latch pin.

10. A step-in binding for receiving a ski boot, comprising:

a base constructed and arranged to be secured to the ski;

a pair of boot support members pivotally supported from a front side of said base, and disposed laterally on either side of said base;

said pair of boot support members being biased to a boot receiving position and further having a locked position that is assumed once the boot is received, engages the pair of boot support members, and is cantilevered downwardly into the locked position;

a release lever arranged at the front of said base readily accessible to the skier and a member that releases the pair of boot support members from the locked position to the boot receiving position upon activation of said release lever; and a ski brake integrated into the base and having wings that extend through the pair of lateral support members.

11. A step-in binding as set forth in claim 10 including at least one spring disposed in the base for biasing the brake and for urging the lateral support members away from the locked position.

12. A step-in binding for receiving a ski boot for telemark skiing, comprising:

a base constructed and arranged to be secured to the ski;

a pair of boot support members pivotally supported from a front side of said base, and disposed laterally on either side of said base;

said boot support members being tapered inwardly toward the front so as to receive and guide the ski boot as it is to be engaged;

said pair of boot support members being biased to a boot receiving position and further having a locked position that is assumed once the boot is received, engages the pair of boot support members, and is cantilevered downwardly into the locked position;

a release lever arranged at the front of said base readily accessible to the skier and a member that releases the pair of boot support members from the locked position to the boot receiving position upon activation of said release lever;

a ski brake integrated into the base, releasable when the boot is disengaged, and constructed and arranged to urge the lateral support members from the locked position to the released position; and wherein the ski brake has opposite legs that engage with respective boot support members.

13. A step-in binding for receiving a ski boot for telemark skiing, comprising:

a base constructed and arranged to be secured to the ski;

a pair of boot support members pivotally supported from a front side of said base, and disposed laterally on either side of said base;

said boot support members being tapered inwardly toward the front so as to receive and guide the ski boot as it is to be engaged;

said pair of boot support members being biased to a boot receiving position and further having a locked position that is assumed once the boot is received, engages the pair of boot support members, and is cantilevered downwardly into the locked position;

a release lever arranged at the front of said base readily accessible to the skier and a member that releases the pair of boot support members from the locked position to the boot receiving position upon activation of said release lever; and a ski brake integrated into the base, releasable when the boot is disengaged, and constructed and arranged to urge the lateral support members from the locked position to the released position;

wherein said base has a pressure plate on a front top surface that firmly engages an underside of the boot, and wherein the pressure plate is slightly elevated above the rest of the top surface of the base.

14. A step-in binding for receiving a ski boot for telemark skiing, comprising:

a base constructed and arranged to be secured to the ski;

a pair of boot support members pivotally supported from a front side of said base, and disposed laterally on either side of said base;

said boot support members being tapered inwardly toward the front so as to receive and guide the ski boot as it is to be engaged;

said pair of boot support members being biased to a boot receiving position and further having a locked position that is assumed once the boot is received, engages the pair of boot support members, and is cantilevered downwardly into the locked position;

a release lever arranged at the front of said base readily accessible to the skier and a member that releases the pair of boot support members from the locked position to the boot receiving position upon activation of said release lever; and a ski brake integrated into the base, releasable when the boot is disengaged, and constructed and arranged to urge the lateral support members from the locked position to the released position;

wherein the member that releases the pair of support members includes a latch pin that extends through the base retained at its front end at the release lever and having a back end that engages and locks the pair of support members.

15. A step-in binding as set forth in claim 14 including a cross piece extending between the lateral support members for engagement with the back end of the latch pin, said latch pin being tapered at its back end so as to displace when the lateral support members move downwardly yet lock with the cross piece when fully engaged, a spring for biasing the latch pin toward a backward position, said base having a front to back passage for receiving said latch pin.

16. A step-in binding as set forth in claim 12 including a cross bar disposed between the pair of boot support members for engaging the front top of the boot and a pair of stop posts associated respectively with the pair of support members.

17. A step-in binding for receiving a ski boot, comprising:

a base constructed and arranged to be secured to the ski;

a pair of boot support members mounted from a front side of said base, and disposed laterally on either side of said base;

said boot support members adapted to receive and guide the ski boot as it is received;

said pair of boot support members being biased to a boot released position and further having a locked position that is assumed once the boot is received, engages the pair of boot support members, and is cantilevered downwardly into the locked position;

a release lever mounted at the front of said base, readily accessible to the skier and including a release member that releases the pair of boot support members from the locked position to the boot released position upon activation of said release lever;

a series of upright engagement pins on the base for engaging similarly disposed holes in the boot sole; and a cross bar between and stationary relative to the pair of boot support members, disposed overlying said engagement pins and for engaging the front top of the boot sole.

18. A step-in binding as set forth in claim 17 including a ski brake integrated into the base, and constructed and arranged to urge the boot support members from the locked position to the released position.

19. A step-in binding as set forth in claim 17 wherein said boot support members are tapered inwardly toward the front so as to receive and guide the ski boot as it is to be engaged.

20. A step-in binding as set forth in claim 17 including two additional crossbars that are used to unify the boot support members.

21. A step-in binding for receiving a ski boot, comprising:

a pair of boot support members mounted from a front side of said base, and disposed laterally on either side of said base;

said boot support members adapted to receive and guide the ski boot as it is received;

said pair of boot support members being biased to a boot released position and further having a locked position that is assumed once the boot is received, engages the pair of boot support members, and is cantilevered downwardly into the locked position;

a release lever mounted at the front of said base, readily accessible to the skier and including a release member that releases the pair of boot support members from the locked position to the boot released position upon activation of said release lever; and three crossbars that are used to unify the boot support members.

wherein the crossbars include a front bar that forms a hinge, a second bar across the top of the boot that holds the boot in place, and a rear bar that locks the boot support members down.

22. A step-in binding for receiving a ski boot, comprising:

a base constructed and arranged to be secured to the ski;

a boot support member supported from a front side of said base and including a pair of separate boot support members each for supporting and guiding opposite sides of the boot sole;

said boot support member being biased to a boot receiving position and further having a locked position that is assumed once the boot is received, engages the boot support member, and is cantilevered downwardly into the locked position;

a release lever arranged at the front of said base readily accessible to the skier and a member that releases the boot support member from the locked position to the boot receiving position upon activation of said release lever;

a ski brake integrated into the base, and constructed and arranged to urge the support member from the locked position to the released position;

at least one cross bar connected between said boot support members, that is disposed over the base and that engages the front top of the ski boot when the ski boot is inserted into the binding; and a common pivot that interconnects the front of the pair of boot support members and that forms both a pivot for the boot support members as well as defining the spacing between the boot support members.

23. A binding for receiving and mounting a ski boot to a ski, comprising:

a base adapted for securing to the ski;

a boot support carriage that is pivotally supported from said base and that is adapted to receive the sole of the ski boot;

said boot support carriage having locked and released positions;

said boot support carriage including;

a pair of separated boot support members that each have a guide surface for guiding the lateral position of the boot and a support surface for supporting a side of the sole of the boot, and at least one cross member that extends between said boot support members, that is disposed over the base and that engages the front top of the ski boot when the ski boot is inserted into the binding; and a common pivot that interconnects the front of the pair of boot support members and that forms a pivot for the boot support members, defines the spacing between the boot support members and arranges the boot support members for motion at the sides of said base.

24. A binding as set forth in claim 23 wherein said boot support members each further include an upright surface that extends beside the base when the binding is in a locked position.

25. A binding as set forth in claim 23 wherein the center of said cross member receives the most forward portion of the toe box of the boot with the ends of the cross member extending rearwardly therefrom to engage outer portions of the boot sole.

26. A binding as set forth in claim 23 wherein said base has a pressure plate on a front top surface that firmly engages an underside of the boot.

27. A binding as set forth in claim 23 further including a ski brake integrated into the base, releasable when the boot is disengaged, and constructed and arranged to urge the lateral support members from the locked position to the released position.

28. A binding as set forth in claim 27 wherein the ski brake has opposite legs that engage with respective boot support members.

29. A binding as set forth in claim 23 further including an engagement plate on the base for engaging the undersurface of the boot sole, and wherein the cross member is stationary relative to the pair of boot support members, disposed overlying said engagement plate and for engaging the front top of the boot sole.

30. A binding for receiving and mounting a ski boot to a ski, comprising:

a base adapted for securing to the ski;

a pair of separated boot support members that are pivotally supported from said base at sides thereof, and that are adapted to receive the sole of the ski boot;

said boot support members having locked and released positions; and a plurality of cross members that interconnect the pair of boot support members to maintain a fixed spacing therebetween and including an overlying member that is disposed over the base and that engages the front top of the ski boot when the ski boot is inserted into the base in the released position, and a cross member, forward of the overlying member, and forming the pivot for the boot support members.

31. A ski binding as set forth in claim 30 wherein the base comprises an upright member, and said boot support members comprise separately disposed members that each include a bottom section that is adapted to pass, respectively, against opposite sides of the upright member when the boot support members are pivoted to a locked position.

32. A ski binding as set forth in claim 31 wherein the pair of boot support members each have a guide surface for guiding the lateral position of the boot and a support surface for supporting a side of the sole of the boot.

33. A ski binding as set forth in claim 32 wherein the support surface is disposed orthogonal to both the guide surface and the bottom section.

34. A ski binding as set forth in claim 30 wherein said overlying member comprises a cross bar and the center of said cross bar receives the most forward portion of the toe box of the boot with the ends of the cross bar extending rearwardly therefrom to engage outer portions of the boot sole.

35. A ski binding as set forth in claim 30 wherein said base has a pressure plate on a front top surface that firmly engages an underside of the boot.

36. A ski binding as set forth in claim 30 wherein said base receives a latch device that releases the boot support members from the locked position to the boot receiving position upon activation of a release lever.

37. A ski binding as set forth in claim 30 further including a series of upright engagement pins on the base for engaging similarly disposed holes in the boot sole, and wherein the overlying member comprises a cross bar that is stationary relative to the pair of boot support members, disposed overlying said engagement pins and for engaging the front top of the boot sole.

38. A binding for receiving and mounting a ski boot to a ski, comprising:

a base adapted for securing to the ski at a fixed position on the ski;

a pair of boot support members that are respectively disposed at opposed sides of said base and that are adapted to receive the sole of the ski boot;

said boot support members having locked and released positions;

a common pivot that intercouples a front of the pair of boot support members with the base and that forms a pivot for the boot support members to enable the boot support members to move in unison between locked and released positions;

an overlying member that pivots with the pair of boot support members, is disposed over the base and engages a top surface of the sole of the ski boot when the ski boot is inserted into the pair of boot support members;

said boot support members and overlying member, upon receiving said boot, being cantilevered downwardly from a released position to a locked position wherein the sole of the ski boot is clamped by the overlying member against the fixed position base.

39. A ski binding as set forth in claim 38 wherein said base is an upright base and said boot support members have respective boot support surfaces for receiving respective sides of the boot sole, said respective boot support surfaces being cantilevered downwardly adjacent the opposed sides of the upright base.

40. A ski binding as set forth in claim 39 wherein said boot support members each include a bottom section that is adapted to pass, respectively, against the opposed sides of the upright base when the boot support members are pivoted to a locked position.

41. A ski binding as set forth in claim 40 wherein the pair of boot support members each have a guide surface for guiding the lateral position of the boot.

42. A ski binding as set forth in claim 41 wherein the boot support surface is disposed orthogonal to both the guide surface and the bottom section.

43. A ski binding as set forth in claim 38 wherein said base has a pressure plate on a front top surface that firmly engages an underside of the boot sole.

44. A ski binding as set forth in claim 38 wherein said base includes boot engagement means for the engagement with the underside of the boot sole, said overlying member urging the duckbill of the sole against the engagement means to hold the boot in place as the boot support members are cantilevered to the locked position.

45. A ski binding as set forth in claim 44 wherein said engagement means comprises pins.

* * * * *